US006092885A

United States Patent [19]

James

[11] Patent Number: 6,092,885

[45] **Date of Patent: *Jul. 25, 2000**

[54] MULTI PURPOSE, FULL SIZE, PORTABLE PODIUM

[76] Inventor: Dan James, 1791 Kirkham Way, Salt Lake City, Utah 84119

[ * ] Notice: This patent issued on a continued prosecution application filed under 37 CFR 1.53(d), and is subject to the twenty year patent term provisions of 35 U.S.C. 154(a)(2).

[21] Appl. No.: 09/023,190

[22] Filed: Feb. 13, 1998

[51] Int. Cl.[7] ..... A47B 19/00

[52] U.S. Cl. ..... 312/233; 312/140.2; 312/249.8; 312/33

[58] Field of Search ..... 312/233, 234, 312/249.8, 223.5, 230, 231, 232, 204, 223.1, 33, 140.1, 140.2; 108/27; D6/419, 425, 426

[56] References Cited

U.S. PATENT DOCUMENTS

| | | | |
|---|---|---|---|
| D. 339,933 | 10/1993 | Fafoutis | D6/419 |
| 2,063,224 | 12/1936 | Bowles | 312/233 X |
| 2,517,262 | 8/1950 | Vincent | 312/33 X |
| 2,597,970 | 5/1952 | Bollettieri | 312/233 |
| 3,443,031 | 5/1969 | Bolick, Jr. | 312/231 X |
| 4,431,080 | 2/1984 | Everhart . | |
| 5,044,595 | 9/1991 | Carr et al. | 312/108 X |
| 5,087,010 | 2/1992 | Walters | 312/7.2 X |
| 5,738,423 | 4/1998 | Alfaro | 312/290 |

*Primary Examiner*—Peter M. Cuomo
*Assistant Examiner*—Hanh V. Tran

[57] ABSTRACT

A durable one-piece portable podium that is lightweight, yet a full size executive type podium, of the type that is easily manufactured and recyclable. The lower portion of the podium has a toe kick (10) and a side connection indentation (12). The back of the podium contains a knee indentation (14) a middle shelf (16) and a top receptacle (18). The top desk (20) contains a pen trough (22) a front rise (24) a light visor (26) and side holds (28). The front of the podium contains an indented, front receptacle (30) that facilitates inserts of various materials, signs, speakers, etc., to customize the looks and or the performance of the podium.

5 Claims, 1 Drawing Sheet

MULTI PURPOSE, FULL SIZE, PORTABLE PODIUM

The present invention is generally related to a portable podium, for speaker, lecturers, and performers such as Disk Jockeys etc., specifically to an executive size podium that is much lighter in weight, more durable, recyclable, versatile, safer and much less expensive.

Portable podiums and the like are common, but have lacked in respects to case of implementation, are generally expensive, are not recyclable, they easily damage walls and doors because of weight, and are easily damaged themselves, due to the type and construction and the materials used.

BACKGROUND OF THE INVENTION

At the present time the general construction of a podium is of wood, or plexi-glass. Full size wood and plastic podiums are very heavy, typically between 95 and 240 pounds, for an executive size podium. There are smaller wooden, plastic, or other material podiums that are not as heavy, but they do not have the look, feel, and performance of an executive size podium and are typically flimsy. There is one prior art full size podium made from a combination of wood and fiberboard it is still heavy, uses multiple parts including wood which extends out from the podium, and is covered with fabric. All of the for-mentioned use several small pieces attached together, lending to the eventual break down of the podium and add to the expense of manufacturing. Because of their weight, it often takes two people to lift a podium on a riser or stage increasing the cost of implementing them. The awkwardness of a heavy podium increases the possibility of damage to the podium, walls, doors, and people moving them. Recycling of the materials used is difficult at best. Wooden podiums are not acceptable to use outdoors because of moisture damage. Even with indoor use, wooden podiums are susceptible to spills that damage podiums, as water is usually offered at the podium for the speaker's use.

To overcome these shortcomings my invention is produced to provide a one piece, durable, lightweight, executive size, recyclable, less expensive, podium, that is easily customized to give variety and beauty. The overall frame of the invention is one molded piece. This avoids the eventual breakdown of the podium, where joints between the different parts eventually break down by moving the podium around of the possible dropping of it. The one-piece design also provides a cost saving in manufacturing, reflecting a much lower cost to the end user. A full size wooden executive podium typically sells from $1200 to $3750 dollars, the price of the invention would be from $500 to $700 dollars even with a wood insert to give it a wood look. Further cost savings are accomplished by molding in features such as penholders, remote holders, rack mount receptacles, etc. The weight of the invention is between 25 and 50 pounds instead of the prior art 95 to 240 pounds. The lighter weight of the invention makes it easier and less expensive to implement. With the tilt back wheels, one person can easily move the podium around and even lift it up on a riser or stage. Because of the rounded corners and the lighter weight it is less likely to accidentally drop the podium, or bump into doors or walls, and if this happens, it would not be likely that any damage would occur. Polyethylene construction allows the podium to be used outside or in harsh environments, as it is not affected by moisture. The indented front receptacle allows for inserts of other materials to be attached to give variety, beauty, and the ability to customize. These inserts are easily and inexpensively manufactured because they are relatively small and only have to be finished on one side as they are surrounded in the inset area. The molding process provides for consistent parts of any color simply by adding the desired pigment in the molding process. Color goes through the part, so scratches are less noticeable. Polyethylene is difficult to dent. The molding process allows the product to be made of recycled materials, and to be easily recycled by simply grinding up the material and remolding it.

BRIEF SUMMARY OF THE INVENTION

The present invention is conventional shape accept more rounded to help prevent damage to walls, doors or the podium. It is molded plastic, and weighs in from 25 to 50 pounds depending on the desired use. It consists of one part with molded in features such as tilt back wheels, 19" rack mount receptacle, indentation in front to allow different decoration and functional fronts, a pen trough and such. It can be recycled easily and usually is made from recycled material. It is of substantial size as to provide a professional look and adequate room on top for papers, rack mount equipment, etc.

A further object of the podium is the indented front allowing for using various materials to be used to customize and improve the beauty of the podium. The indentation provides protection for the insert so if it is a fragile substance, such as wood, it will look new longer. The front can also be left plain, and or speakers, molded in graphics, or attached emblems can be added.

Figure 1:
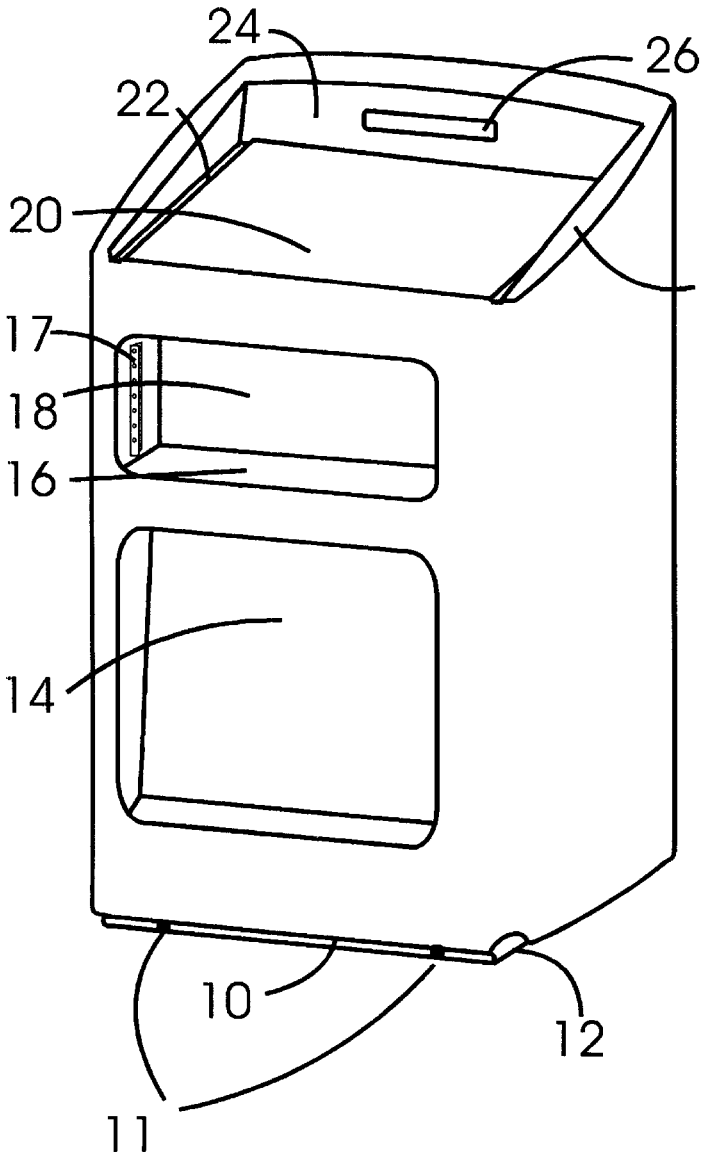
FIG. 1. is a perspective view of the invention showing the back, including the conventional 19" rack receptacle, the side and top of the podium.

| REFERENCE NUMERALS IN DRAWING | |
|---|---|
| 10 toe kick area | 12 side connection indentation |
| 14 knee indentation | 16 middle shelf |
| 18 top receptacle | 20 top desk |
| 22 pen trough | 24 front rise |
| 26 light visor | 28 side holds |
| 30 front receptacle | |

DETAILED DESCRIPTION OF THE INVENTION

Referring to the drawings somewhat more in detail the podium according to the present invention is illustrated in figures one and two, showing a perspective view and the front of the podium. Other objects and advantages of the invention will become more apparent from the specification taken in conjunction with the accompanying drawings, in which FIG. 1. shows a perspective view of a basic version of my podium. The drawing shows the one-piece design of the podium including back, top, and side. It is manufactured using a rotational molding process where the interior of the device is hollow. The walls of the podium are thin, approximately ¼" making it light weight, if more rigidity is needed the walls may be made thicker by using more plastic or using an outer layer of plastic and a foamed layer of plastic on the interior. The typical material used is polyethylene but other composite or plastic materials may be used. At the bottom of the podium is the toe kick 10 showing the indented lowest part of the back for a toe kick, and an area 11 for the mounting of conventional tilt back wheels. Front of the toe kick is the side connection indentation 12 showing the indented lowest part on the side for audio, video, power, and other connectors. Further up the back is the knee indentation 14 of the lower half of the podium, which is indented to allow space for bending knees, conventional 19" rack mount and other devices. This section may also be cut out to provide space to store articles such as portable speakers. Further up the back is shown the middle shelf 16 that projects back out to allow for added on, or molded in cup/pen holders, etc. Further up the back just under the top desk is the top receptacle 18 which is indented to allow room for cup holders etc., and to allow conventional 19" rack-mount or other devices to be mounted to the podium by way of conventional rack rails 17. The top of the podium shows the desk 20, which is used to set objects such as presentation devices, or notes, needed by the user of the podium. On the desk portion is a molded in pen trough 22. Rising from the forward part of the desk to the top front of the podium is the front rise 24, this portion is available to mount other devices such as clocks, video monitors, etc. The light visor 26 is centered on the front rise. On either side of the top portion of the podium are the side holds 28 provided to give protection from things rolling of to the side and to hold on to while standing behind the podium.

Figure 2:
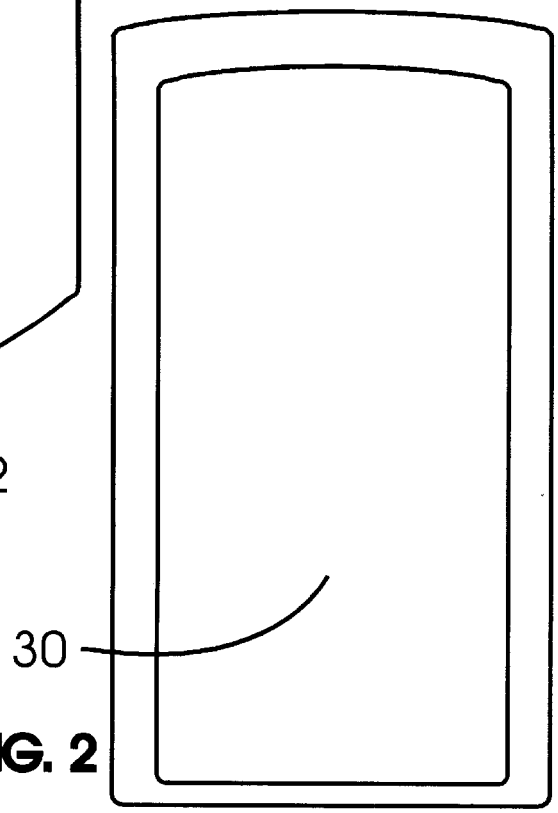
FIG. 2 is front view of the invention, showing the front receptacle, which is indented to allow fastening a decorative insert.

FIG. 2. shows the front view of the podium, with the front receptacle. The front receptacle 30 shows the location where either wood, plastic laminated wood, metal, carpet, or other materials may be added to customize and give variety, and beauty to the podium. The indentation in the front may be left plain, incorporate molded in graphics, or used also for placing speakers, conventional 19" rack-mount devices, signs etc.

OPERATION OF THE INVENTION

The manner of operation of the podium is typically to stand to the rear of the podium where all the features are accessible. To use the conventional tilt back wheels, one needs to stand at the back of the podium and tilt it back at least ten degrees and wheel or push forward. To use the podium set it in its upright position. Right angled or flat conventional 19" rack mount rails can be attached to the sides or face of the top receptacle and knee indentation areas. Inserts for the front can be mounted in a variety of ways including using fasteners such as wood screws, molly bolts, T-nuts and bolts, or by using glues, tapes, or hooking fabrics or plastics. Accessories such as clocks, and glass holders can be mounted by cutting out the necessary plastic and attaching the devices in various ways. If speakers are mounted, most common fasteners designed for speakers will work on the plastic.

SUMMARY, RAMIFICATIONS AND SCOPE

Thus the reader will see that the multi use portable podium is durable, light weight, recyclable, inexpensive, one piece, executive size, podium, that is easily customized.

While my above description contains many specificities, these should not be construed as limitations on the scope of the invention, but rather as an exemplification of the one preferred embodiment thereof. Many other variations are possible. For example podiums are used in many applications besides the ones mentioned here. There are many accessories that could be attached to this podium and many different types of inserts placed in the front receptacle. The over all shape of the podium may be altered to add variety and fit a specific use. The width of the podium can be altered to meet general and specific uses. The height of the podium can be made higher to accommodate taller requirements or lowered it accommodate children, or other needs requiring a shorter podium. Fragmentation or custom molded in receptacles such as remote control holders, glass holders, signs, or other devices can be molded in and are too numerous to mention here, yet are included in the scope of the invention.

Accordingly, the scope of the invention should be determined not by the embodiments illustrated, but by the appended claims and their legal equivalents.

I claim:

1. An integrally molded plastic podium comprising:

a top wall having a top surface; a bottom wall; a front wall extending upwardly from the bottom wall and having a portion extending above said top wall; two side walls extending upwardly from said bottom wall each having a portion extending above said top wall; a back wall having openings;

at least one receptacle provided in the front wall for receiving a decorative insert;

a tilt back wheel receiving area at the bottom of the back wall for receiving tilt back wheels for ease of transporting;

at least one recess or indentation provided at an outside bottom corner of the podium near the tilt back wheel area for mounting of electronic connectors, said at least one recess or indentation having a depth such that an electronic connector being mounted thereon does not protrude beyond the side wall;

rail means attached to inner surfaces of said side walls for mounting electronic equipments.

2. The integrally molded plastic podium of claim 1, wherein a toe kick area is provided at the bottom of the back wall allowing a person to stand close at the back of the podium.

3. The integrally molded plastic podium of claim 1, further comprising a shelf.

4. The integrally molded plastic podium of claim 1, wherein said top surface includes at least one trough or recess for placing and receiving articles thereon.

5. The integrally molded plastic podium of claim 1, further comprising a light visor attached to an inner surface of said front wall above said top surface.

* * * * *